United States Patent [19]

Scholz et al.

[11] Patent Number: 4,906,887

[45] Date of Patent: Mar. 6, 1990

[54] HIGH PRESSURE METAL VAPOR LAMP WITH OUTER PROTECTIVE ENVELOPE AND GETTERS THEREIN

[75] Inventors: John A. Scholz, Danvers; Elliot Wyner, Peabody, both of Mass.

[73] Assignee: GTE Products Corporation, Danvers, Mass.

[21] Appl. No.: 286,678

[22] Filed: Dec. 19, 1988

[51] Int. Cl.[4] ..... H01J 61/34; H01J 61/26

[52] U.S. Cl. ..... 313/25; 313/113; 313/554; 313/559

[58] Field of Search ..... 313/559, 554, 25, 113, 313/553

[56] References Cited

U.S. PATENT DOCUMENTS

| | | | |
|---|---|---|---|
| 3,626,229 | 12/1971 | Spacil et al. | 313/554 X |
| 4,253,037 | 2/1981 | Driessen et al. | 313/25 |
| 4,333,032 | 6/1982 | Wyner et al. | 313/554 |
| 4,345,178 | 8/1982 | Pappas et al. | 313/25 X |
| 4,651,048 | 3/1987 | Liebe | 313/25 |
| 4,758,759 | 7/1988 | Scholz et al. | 313/25 |
| 4,771,207 | 9/1988 | Page | 313/25 |

*Primary Examiner*—Palmer C. DeMeo

*Attorney, Agent, or Firm*—Martha Ann Finnegan

[57] ABSTRACT

A high pressure metal vapor lamp including an outer protective envelope having a lens and a reflector member having a base for connecting the lamp to a source of electrical power. An elongaated arc tube is provided extending cross-axially relative to the axis of the lamp, the arc tue being supported by leads extending from the base. A pair of barium flash getters is provided extending from respective ends of the arc tube towards, and in close proximity to, the lens and facing the reflector member.

14 Claims, 2 Drawing Sheets

HIGH PRESSURE METAL VAPOR LAMP WITH OUTER PROTECTIVE ENVELOPE AND GETTERS THEREIN

BACKGROUND OF THE INVENTION

1. Field of the Invention

The present invention relates to a high pressure metal vapor lamp.

2. Description of the Prior Art

Generally, high pressure metal vapor lamps include an outer protective envelope, an arc tube supported therein and containing a discharge sustaining filling, appropriate electrodes operatively associated with such filling and electrically connected to a base member which connects the lamp to a source of electrical power, and gettering means within the protective envelope. During the use of such a high pressure metal lamp it is necessary for the arc tube to operate at a suitable high temperature in order to obtain the high efficiency which such lamps are capable of achieving. Such operating temperature can be as high as about 1250° C. In view of such a high temperature the lamp needs to have a high degree of vacuum within the protective envelope, which forms the outer jacket, in order to conserve heat and insure optimum operating conditions. The degree of evacuation required is not readily achieved during high volume production, and therefore it is necessary to provide an auxiliary means for obtaining the degree of vacuum required above that which is obtained using the high volume production processing equipment presently available. To this end, an evaporable getter, or a non-evaporable getter of the type incorporated within the outer jacket, are typically provided to remove residual gases that remain after conventional evacuation by pumping.

In addition to removing residual gases during initial gas processing, getters contribute to the longevity of the lamp since getters continue gettering throughout the life of the lamp thereby providing thermal insulation effected by the vacuum in the outer jacket. In addition, continued gettering serves to entrap gases that are outgassed or emitted from internal lamp components and from the heated outer jacket long after initial lamp processing. This is very important, since hydrogen or oxygen liberated from some of the constituents of the outer jacket can react with the arc tube electrical feedthrough, causing premature seal failure.

There are various problems associated with getter processing or activation. For example, one known non-evaporable type of getter requires a heat activation treatment in the range of 850° C. to 900° C. for 25 to 35 seconds and further requires getter placement within the outer jacket of the lamp in a region having temperatures in excess of 250° C. Alternatively, the conventional evaporable Barium flash-type getter is typically in the form of a BaAl4+Ni mix held within an open ring substructure which must be heated to 900° to 1000° C. for a couple of seconds in order to initiate the reaction which liberates the barium for deposition on the wall(s) of the lamp jacket. The evaporable and non-evaporable getters traditionally have used a high frequency heat induction method which couples the induction coils to the getter to perform the required heating. This process is not encumbered owing to the transparent nature of the glass outer jacket. However, the deposited barium film is opaque in nature, making it necessary for the getter to be positioned near the base of the lamp so that the deposition will not interfere with the light output. For example, heretofore, getters of the type discussed above have been used with conventional clear outer jackets or those having an inner surface diffusing coating. Such lamps are of a linear construction by which is meant that their components are stacked in a linear fashion including base, flare stem, elongated arc tube, spring mount, etc. In essence, the arc tube extends along an axis of the lamp which axis extends from the base towards the lens. U.S. Pat. Nos. 4,197,480, 4,333,032, and 4,467,238 describe sodium lamps of this type wherein the arc tube extends along such an axis. The type of getter typically used in this type of lamp is the barium flash getter, and the lamp configuration necessitates that the getter be located in a region near the base of the lamp as described in U.S. Pat. No. 4,333,032. Such positioning of the getter assures that the flashed non-transparent film will have a minimal effect upon light output. In the lamp of U.S. Pat. No. 4,333,032 the barium flash serves as a dominant source for photoelectron emission. However, such an emission causes sodium migration from the arc tube, the depletion of sodium in this manner tending to eventually lead to arc tube darkening and premature lamp failure.

Deviation from the conventional linear type of construction to a more compact unit having an aluminized reflector might be considered. However, it is believed that obstacles relating to such a lamp include (1) an inability to couple the high frequency induction heating to the getter when the getter is enclosed in a sheath of aluminum, and (2) the coupling of the aluminum coating with the high frequency energy causes heating and vaporization of the aluminum coating thereby causing a loss of reflective coating and a redeposition of the vaporized aluminum onto the arc tube and lens. If it were possible to flash a barium-type getter in such a lamp, the getter would be exposed to direct arc tube radiation and the attendant undesirable effects.

In one known type of high pressure sodium lamp having an aluminized reflector, an axially mounted arc tube is provided having a non-evaporative getter on opposite sides of the arc tube. Since it is preferred to provide high pressure sodium lamps with a barium flash getter, the use of the non-evaporative getter in this embodiment appears to be a compromise in gettering performance. In addition, the foregoing lamp design includes a costly dichroic reflective coating. As discussed in U.S. Pat. No. 4,197,480, a dichroic coating dissipates radiation out the back of the reflector thereby decreasing the lens operating temperature to the required level. However, such a coating also allows a considerable amount of visible light to escape.

An object of the invention is to provide an improved high pressure metal vapor lamp. Another object of the invention is to provide a high pressure metal vapor lamp including an evaporable barium getter which can be positioned other than at the base of the lamp without having the deposited barium film interfere with the light output. A further object of the invention is to provide a high pressure metal vapor lamp including an evaporable barium getter wherein sodium migration from the arc tube of the lamp is minimized, if not eliminated. A still further object of the invention is to provide a more compact high pressure metal vapor lamp having an aluminized reflector and including a barium flash getter which is not exposed to direct arc tube radiation and the attendant undesirable effects. Another object of the invention is to provide a high pressure metal vapor lamp which does not require the use of a dichroic coating to decrease the lens operating temperature.

SUMMARY OF THE INVENTION

The invention achieves these and other results by providing a high pressure metal vapor lamp, comprising an outer protective envelope having a front member through which visible light can pass and a rear reflector member which is generally parabolic. The outer protective envelope extends from the front member towards the rear reflector member along a first axis. A base means is affixed to the rear reflector member for connecting the lamp to a source of electrical power. An elongated arc tube extends along a second axis. The arc tube has a discharge sustaining filling therein and includes an electrode operatively disposed proximate each end thereof. An electrical connector is connected to each electrode. Supporting means extend from the base means to a respective electrical connector for supporting the elongated arc tube within the outer protective envelope such that the second axis is disposed substantially at 90° relative to the first axis. The supporting means electrically connects the electrodes to the base means. A first barium flash getter is electrically connected to the supporting means at one end of the elongated arc tube, and a second barium flash getter is electrically connected to the supporting means at the opposite second end of the elongated arc tube. The first and second barium flash getters extend from respective ends of the elongated arc tube towards, and in close proximity to, the front member. The getters face the rear reflector member.

DESCRIPTION OF THE PREFERRED EMBODIMENT

Figure 1:
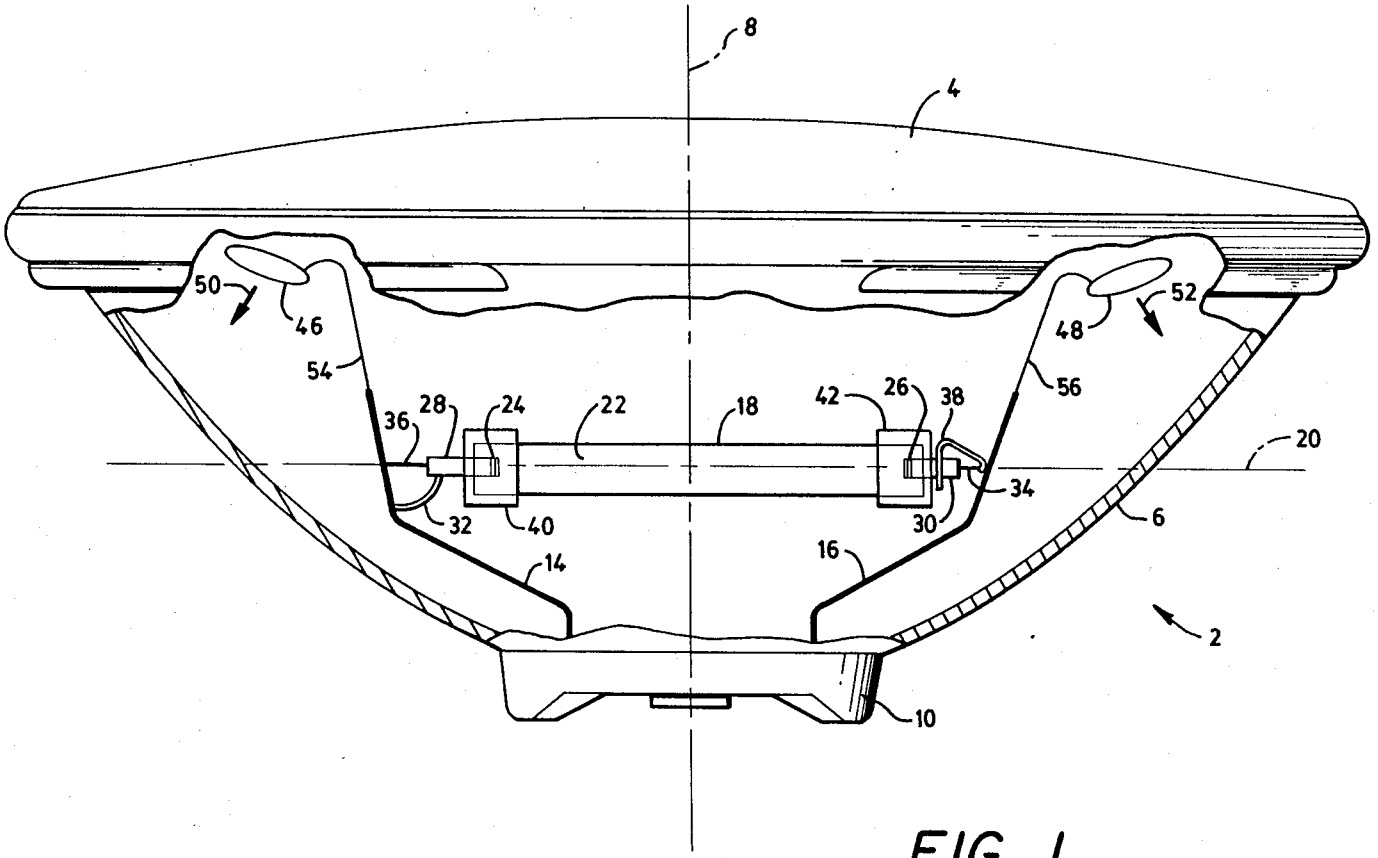
FIG. 1 is an elevational view, partly in section, of a high pressure metal vapor lamp of the present invention.
Figure 2:
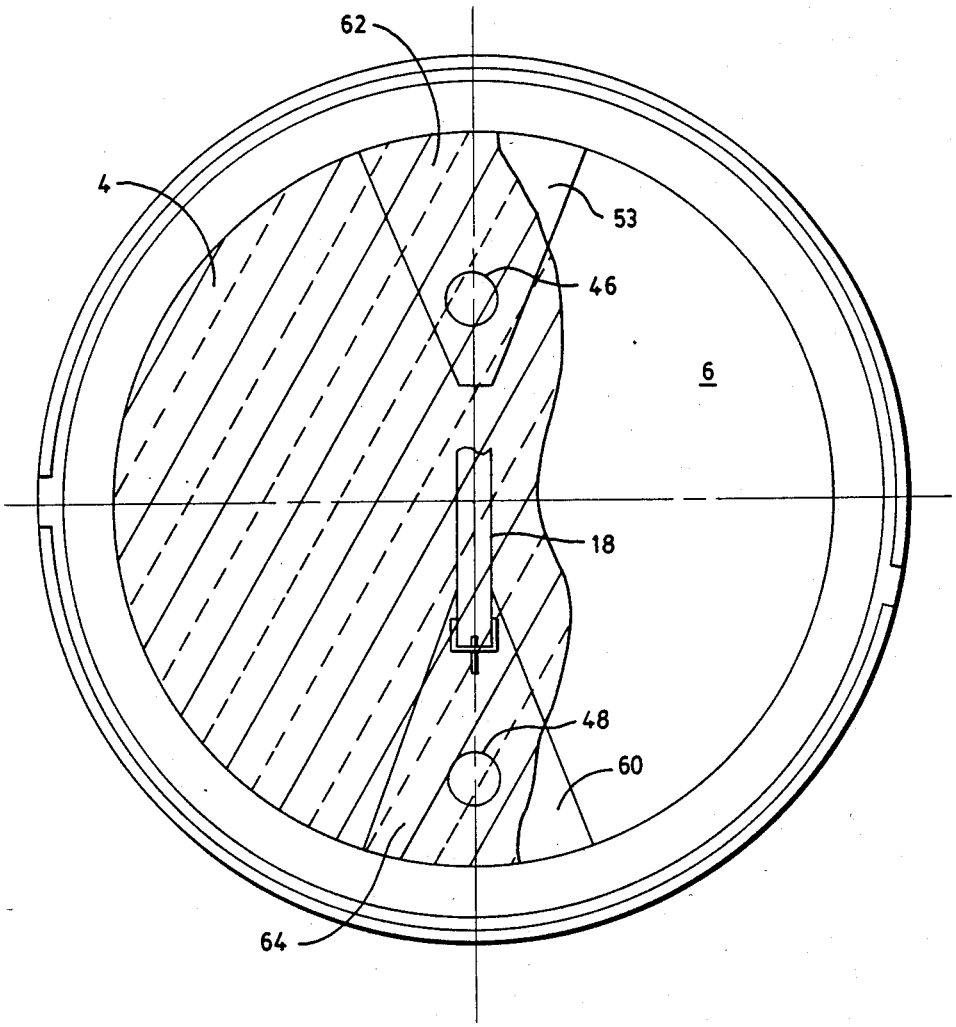
FIG. 2 is a diagrammatic plan view of a high pressure metal vapor lamp of the present invention.

The embodiment which is illustrated in FIGS. 1 and 2 is particularly suited for achieving the objects of this invention. FIG. 1 depicts a high pressure metal vapor lamp 2 comprising an outer protective envelope having a front member 4 in the form of a glass lens through which visible light can pass and a rear reflector member 6 which is generally parabolic. In the preferred embodiment the rear reflector member is an aluminized reflector. The outer protective envelope extends from front member 4 towards rear reflector member 6 along a first axis 8.

A base means is affixed to the rear reflector member in a known manner for connecting the lamp 2 to a source of electrical power (not shown). For example, a base means in the form of an electrical adaptor 10 of a known type is affixed to the reflector member 6 for connection to a suitable ballasting means and voltage source. Suitable ballasting means are readily identifiable by those in the art. A pair of electrically conductive leads 14 and 16 are sealed into and electrically connected to the electrical adapter 10 in a known manner.

An a elongated arc tube 18 extends along a second axis 20. Arc tube 18 has a discharge sustaining filling 22 therein. For example, in the preferred embodiment, the discharge sustaining filling is sodium and mercury. However, it is not intended to limit the present invention in this manner. For example, a discharge sustaining filling selected from the metals consisting of mercury, sodium, cadmium, thallium or zinc is also useful in the metal vapor lamp of the present invention.

The elongated arc tube 18 includes an electrode operatively disposed proximate each end thereof. For example, arc tube 18 includes spaced electrodes 24 and 26 disposed at opposite ends thereof with each of the electrodes 24 and 26 affixed to a niobium tube 28 and 30 sealed into and passing through the ends of the arc tube 18. The leads 14 and 16 serve to electrically connect electrodes 24 and 26 to base means 10. In particular, electrical connectors 32 and 38 are provided having one end electrically connected to respective electrodes 24 and 26 by means of respective niobium tubes 28 and 30, and an opposite end electrically connected to leads 14 and 16. Leads 14 and 16 also provide a supporting means extending from the base means 10 for supporting the elongated arc tube 18 within the outer protective envelope such that the second axis 20 is disposed substantially at 90° relative to the first axis 8. Rods 34 and 36 support niobium tubes 28 and 30 from leads 14 and 16. Optionally, one or both of the support rods may be welded to the niobium tubes.

In the embodiment illustrated in FIG. 1, shield members 40 and 42 encircle the ends of the arc tube 18 in the region of the electrodes 24 and 26. Use of such shield members may be optional in alternative embodiments of the invention.

A first barium getter 46 is electrically connected to lead 14 near one end of the elongated arc tube 18 and a second barium flash getter 48 is electrically connected to lead 16 at the opposite end of the elongated arc tube 18. As can be seen in FIG. 1, getters 46 and 48 extend from regions adjacent respective ends of the elongated arc tube 18 towards, and in close proximity to, the front member or lens 4. Each getter faces the rear reflector member 7 as generally designated by arrows 50 and 52. In the Preferred embodiment each barium flash getter 46 and 48 is an open ring getter as best depicted in FIG. 2. In the embodiment of FIG. 1 a first lead 54 has one end welded to open ring getter 46 and an opposite end welded to the lead 14. In a like manner, a second lead 56 is provided, having one end welded to the open ring getter 48 and an opposite end welded to the lead 16. In this manner, the barium flash getters are supported by the supporting means for the elongated arc tube 18.

The combination of the barium flash getters and cross axial arc tube has proved very effective. For example, use of the cross axial arc tube affects a relatively unused portion of the reflector. In particular, a portion of the reflector is provided which is not exposed to direct arc tube radiation. By using this portion of the reflector for the flashed barium film, an improved high pressure metal vapor lamp can be produced wherein the barium getter can be effectively positioned other than at the base of the lamp without having the deposited barium film interfere with light output. In particular, such an improved metal vapor lamp functions with very limited, if any, arc tube darkening caused by sodium migration/electrolysis.

LAMP TEST RESULTS

A lamp test was performed to compare the performance of lamps in accordance with the present invention with the performance of lamps which included the barium flash getter located below the cross-axially mounted arc tube (immediately above the tubulation hole). The lamp test was conducted using 35 watt PAR-46 type lamps with aluminized reflectors and cross-axially mounted arc tubes. The arc tube included in each lamp had the following dimensions: approximately 4.0 mm inside diameter, approximately 5.2 mm outside diameter, approximately 0.46 $cm^3$ arc tube volume, approximately 20 mm arc length, approximately 37 mm cavity length. The arc tube of each lamp included 4.4 mg sodium and 17.6 mg mercury. Each lamp employed a conventional 35 watt ballast.

In Examples 1 and 2 (the Control Group), the barium flash getter for each lamp was located below the cross-axially mounted arc tube (immediately above the tubulation hole). In Examples 3 and 4 (lamps of the invention), ring getters were affixed to the arc tube end and close to the lens to facilitate induction heating and to utilize the unused portion of the reflector for the eventual deposition of the barium film. The results for the lamp test are summarized in the following Table.

TABLE

| | VISUAL ARC TUBE APPEARANCE | | | |
|---|---|---|---|---|
| HOURS OF OPERATION | CONTROL GROUP EXAMPLE 1 | CONTROL GROUP EXAMPLE 2 | PRESENT INVENTION EXAMPLE 3 | PRESENT INVENTION EXAMPLE 4 |
| Initial | Good* | Good | Good | Good |
| 250 | Good | Darkening | Good | Good |
| 316 | Darkening | | Good | Good |
| 1000 | | | Good | Good |
| 2000 | | | Good | Good |
| 3000 | | | Good | Good |
| 4000 | | | Good | Good |
| 5000 | | | Good | Good |

As illustrated by the foregoing results, lamps of the present invention displayed no visible signs of arc tube darkening (sodium migration/electrolysis) after 5000 hours of operation, while lamps fabricated according to heretofore known technology exhibited visible arc tube darkening after as little as 250 hours operating time.

To further understand the cross axial orientation of the arc tube, reference is made to FIG. 2 which diagramatically depicts the orientation of the arc tube 18 relative to the rear reflector member 6. In particular, the rear reflector member 6 includes a first area 58 and a second area 60 which are not exposed to direct radiation of the elongated arc tube 18 during use of the lamp 2. In such embodiment the barium flash getters 46 and 48 are extended by means of respective leads 54 and 56 (not shown in FIG. 2) towards corresponding first region 62 and corresponding second region 64 of front member or lens 4, regions 62 and 64 being opposite to areas 58 and 60, respectively. Pairs of regions 58, 62 60, and 64 are depicted as generally wedge-shaped congruent areas in FIG. 2. In the embodiment of FIGS. 1 and 2, first area 58 and second area 60 are opposite to respective ends of the elongated arc tube 18, and the getters 46 and 48 extend towards regions 62 and 64, respectively. In essence, the orientation of the getters and cross axial arc tube is such as to direct the emitted barium film onto the aluminized reflector in the preferred location and at the same time position the getters in reasonably close proximity to the lens of the lamp, which permits satisfactory coupling to the high frequency induction apparatus with negligible interference from the reflector.

The preferred embodiment of the improved high pressure metal vapor lamp of the present invention combines the open ring-type barium flash getters with a cross axial arc tube supported within an outer protective envelope which includes an economical aluminized reflector. It should be noted that use of the aluminized reflector is advantageous owing to the ease of continuous in-line aluminization, as compared to the off-line separate batch processing that is required for dichroic coatings. The lamp of the present invention produces a desirable 2 to 1 illumination pattern which is more conducive when compared, for example, to a circular spot, for security lighting. In particular, when using the lamp of the present invention, it is possible to illuminate a length of building or the like without excessive light on the ground in front of, or in the air above, the region of desired illumination.

The embodiments which have been described herein are but some of several which utilize this invention and are set forth here by way of illustration, but not of limitation. It is apparent that many other embodiments which will be readily apparent to those skilled in the art may be made without departing materially from the spirit and scope of this invention.

We claim:

1. A high pressure metal vapor lamp, comprising:

an outer protective envelope having a front member through which visible light can pass and a rear reflector member which is generally parabolic, said outer protective envelope extending from said front member towards said rear reflector member along a first axis;

base means affixed to said rear reflector member for connecting said lamp to a source of electrical power;

an elongated arc tube extending along a second axis and having a discharge sustaining filling therein, said elongated arc tube including an electrode operatively disposed proximate each end thereof;

an electrical connector connected to each electrode;

supporting means extending from said base means to a respective electrical connector for supporting said elongated arc tube within said outer protective envelope such that said second axis is disposed substantially at 90° relative to said first axis, and for electrically connecting said electrodes to said base means; and a first barium flash getter electrically connected to said supporting means near one end of said elongated arc tube, and a second barium flash getter electrically connected to said supporting means at the opposite second end of said elongated arc tube, said first and second barium flash getters extending from regions adjacent respective ends of said elongated arc tube towards, and in close proximity to, said front member, and facing said rear reflector member.

2. The high pressure metal vapor lamp of claim 1 wherein said first and second barium flash getters are respective first and second open ring getters.

3. The high pressure metal vapor lamp of claim 2 wherein said rear reflector member is an aluminized reflector.

4. The high pressure metal vapor lamp of claim 3 wherein said rear reflector member includes first and second areas which are not exposed to direct radiation of said elongated arc tube, and wherein said first and second barium flash getters extend towards first and second regions of said front member which are opposite respective of said first and second areas.

5. The high pressure metal vapor lamp of claim 1 wherein said rear reflector member includes first and second areas opposite to respective of the ends of said elongated arc tube and wherein said first and second barium flash getters extend towards first and second regions of said front member which are opposite respective of said first and second areas.

6. The high pressure metal vapor lamp of claim 5 wherein said rear reflector member is an aluminized reflector.

7. The high pressure metal vapor lamp of claim 1 wherein said rear reflector member is an aluminized reflector.

8. The high pressure metal vapor lamp of claim 4 including a first lead one end of which is welded to said first open ring barium flash getter and an opposite end of which is welded to said supporting means at said one end of said elongated arc tube, and further including a second lead one end of which is welded to said second open ring barium flash getter and an opposite end of which is welded to said supporting means at said opposite second end of said elongated arc tube.

9. The high pressure metal vapor lamp of claim 8 wherein said discharge sustaining filling comprises sodium and mercury.

10. The high pressure metal vapor lamp of claim 8 wherein said discharge sustaining filling is selected from the metals consisting of mercury, sodium, cadmium, thallium or zinc.

11. A high pressure metal vapor lamp, comprising:

an outer protective envelope having a front glass lens through which visible light can pass and an aluminized rear reflector member which is generally parabolic, said outer protective envelope extending from said front glass lens toward said aluminized rear reflector member along a first axis;

a base means affixed to said aluminized rear reflector member for connecting said lamp to a source of electrical power;

an elongated arc tube extending along a second axis and having a discharge sustaining filling therein, said elongated arc tube including an electrode operatively disposed proximate each end thereof, said aluminized rear reflector member including first and second areas which are not exposed to direct radiation of said elongated arc tube when in use;

an electrical connector connected to each electrode;

supporting means extending from said base means to a respective electrical connector for supporting said elongated arc tube within said outer protective envelope such that said second axis is disposed substantially at 90° relative to said first axis, and for electrically connecting said electrodes to said base means; and a first open ring barium flash getter electrically connected to said supporting means near one end of said elongated arc tube, and a second open ring barium flash getter electrically connected to said supporting means at the opposite second end of said elongated arc tube, said first and second open ring barium flash getters extending from regions adjacent respective ends of said elongated arc tube towards, and in close proximity to, said front glass lens, and facing said aluminized rear reflector member, said first and second open ring barium getter extending towards first and second regions of said front glass lens which are opposite respective of said first and second areas.

12. The high pressure metal vapor lamp of claim 11 including a first lead one end of which is welded to said first open ring barium flash getter and an opposite end of which is welded to said supporting means at said one end of said elongated arc tube, and further including a second lead one end of which is welded to said second open ring barium flash getter and an opposite end of which is welded to said supporting means at said opposite second end of said elongated arc tube.

13. The high pressure metal vapor lamp of claim 12 wherein said discharge sustaining filling comprises sodium and mercury.

14. The high pressure metal vapor lamp of claim 12 wherein said discharge sustaining filling is selected from the metals consisting of mercury, sodium, cadmium, thallium or zinc.

* * * * *